US005893179A

United States Patent [19]

Johnson

[11] Patent Number: 5,893,179

[45] Date of Patent: Apr. 13, 1999

[54] SHEET STYLE WATERFALL FIXTURE

[75] Inventor: Bruce R. Johnson, Parkland, Fla.

[73] Assignee: Jandy Industries, Inc., Novato, Calif.

[21] Appl. No.: 08/919,855

[22] Filed: Aug. 28, 1997

[51] Int. Cl.[6] ..... E04H 4/00

[52] U.S. Cl. ..... 4/507; 4/509

[58] Field of Search ..... 4/492, 507, 509, 4/510, 512, 488; 239/590.3, 590.5, 597, 553, 553.3, 553.5, 590

[56] References Cited

U.S. PATENT DOCUMENTS

| | | | |
|---|---|---|---|
| 4,730,786 | 3/1988 | Nelson | 239/590 |
| 4,881,280 | 11/1989 | Lesikar | 4/507 |
| 4,912,782 | 4/1990 | Robbins | 4/192 |
| 5,115,974 | 5/1992 | Tobias et al. | 239/23 |
| 5,127,111 | 7/1992 | Sieth | 4/591 |
| 5,169,065 | 12/1992 | Bloch | 239/11 |
| 5,309,581 | 5/1994 | Lockwood et al. | 4/507 |
| 5,537,696 | 7/1996 | Chartier | 4/507 |
| 5,738,280 | 4/1998 | Ruthenberg | 239/17 |

*Primary Examiner*—David J. Walczak

*Attorney, Agent, or Firm*—Limbach & Limbach L.L.P.

[57] ABSTRACT

A waterfall fixture for expelling water in sheet form comprises a housing having a cavity divided into chambers by apertured plates extending across the cavity. The plates are apertured and spaced from each other and from the inlet and outlet of the fixture to define multiple chambers within the cavity separated from one another by the plates. A first plate is opposed to the inlet and acts as a screen to block debris and as a barrier to incoming water to distribute the water into a laminar flow through the chamber defined between the first plate and the inlet. A second plate is opposed to the first screen and helps to further distribute the water into laminar flow and may be valved to assure a perfect laminar sheet style water flow pattern.

28 Claims, 8 Drawing Sheets

SHEET STYLE WATERFALL FIXTURE

FIELD OF THE INVENTION

This invention relates to a self-contained plumbing fixture used to create waterfalls, especially near pools or in landscapes.

In order to enhance the aesthetic qualities of a pool, spa or other landscaped area, it is not uncommon to add a waterfall which is visually pleasing, as well as acoustically soothing and relaxing. The waterfall is generally integrated into the plumbing system of a pool or spa, taking water from the pool and passing it over a weir at the edge of the pool.

Previous waterfalls, though, had the disadvantage of not always producing a laminar flow of water from the pool's edge to the surface of the pool. In order to solve this problem, an apparatus for producing a sheet waterfall was developed which contained a conduit with a series of apertures for smoothing and slowing the flow of the water which passed through the conduit. The smoothed and slowed water was then passed through the opening at the side of the pool, creating a laminar flow and an aesthetically pleasing waterfall. U.S. Pat. No. 5,537,696.

Even the improved waterfall of Pat. No. 5,537,696 still has been known to experience problems with water flow restriction, debris containment, clogging of openings and water balance. Rocks, dirt, leaves, or other debris can become trapped in the waterfall unit, or at the point where the water exits the unit, during operation or at the time of construction. When material is trapped, the water flow is interrupted, resulting in a broken sheet of water, or no water at all flowing through the waterfall unit. In the past, rock traps have been used in conjunction with the plumbing of a waterfall unit to aid in preventing rocks and debris from entering the waterfall unit. However, the rock traps are not completely successful, and debris still presents a problem to uninterrupted enjoyment of a trouble free laminar water flow.

In order to solve these problems, a cost-efficient means for removing debris not contained by the rock trap is necessary.

SUMMARY OF THE INVENTION

It is an object of this invention to provide swimming pool contractors, builders and landscapers with a compact trouble free waterfall fixture feature which produces a controllable uninterrupted laminar flow with a simple installation and guaranteed results.

In order to achieve this object, the present invention provides at least two screens for use inside the main conduit of the waterfall unit. The first screen is designed as an initial barrier to the incoming water. It is provided with a series of apertures which are small enough to block debris from passing through to the second screen or to the waterfall unit's exit portion. When debris hits the screen, its velocity is slowed, and the debris falls to the bottom of the unit where it is retained, but provides no restriction. The apertures have the added benefit of helping to begin distributing the water into a laminar flow and to begin reducing the velocity of the water entering the unit. The second screen also comprises a series of apertures, designed to distribute the water into a laminar flow, but the second screen can also be customized or valved with a pattern of openings thereby distributing the water in unique patterns to assure a perfect laminar sheet style water flow pattern.

In other embodiments of the invention, a three or four screened unit is utilized employing one or two intermediate screens between the first screen and the final screen. The first screen, with its apertures, again performs the function of distributing water, slowing water velocity, and most importantly, stopping debris from being passed along to the remainder of the unit. The intermediate screen or screens, also contain a plurality of apertures restricted in strategic areas to help smooth out the water flow. The apertures may be restricted either by reducing the size of the apertures from the first screen to the intermediate screens, or by simply blocking off a number of apertures in the intermediate screens. The restriction contributes to providing an uninterrupted laminar flow of water out of the waterfall unit The final screen, also provided with a plurality of apertures, serves to further distribute water in a laminar flow, and again slows the water before it reaches the waterfall opening.

Other objects, features and advantages will become apparent from a reading of the specification when taken in conjunction with the drawings.

BRIEF DESCRIPTION OF THE DRAWINGS

The present invention will be better understood by reference to the appended drawing figures, of which.

DETAILED DESCRIPTION OF THE INVENTION

The present invention provides an unusually effective fixture for producing a sheetlike waterfall at the edge of a pool or spa. The figures depict the preferred embodiments of the invention.

Figure 1:
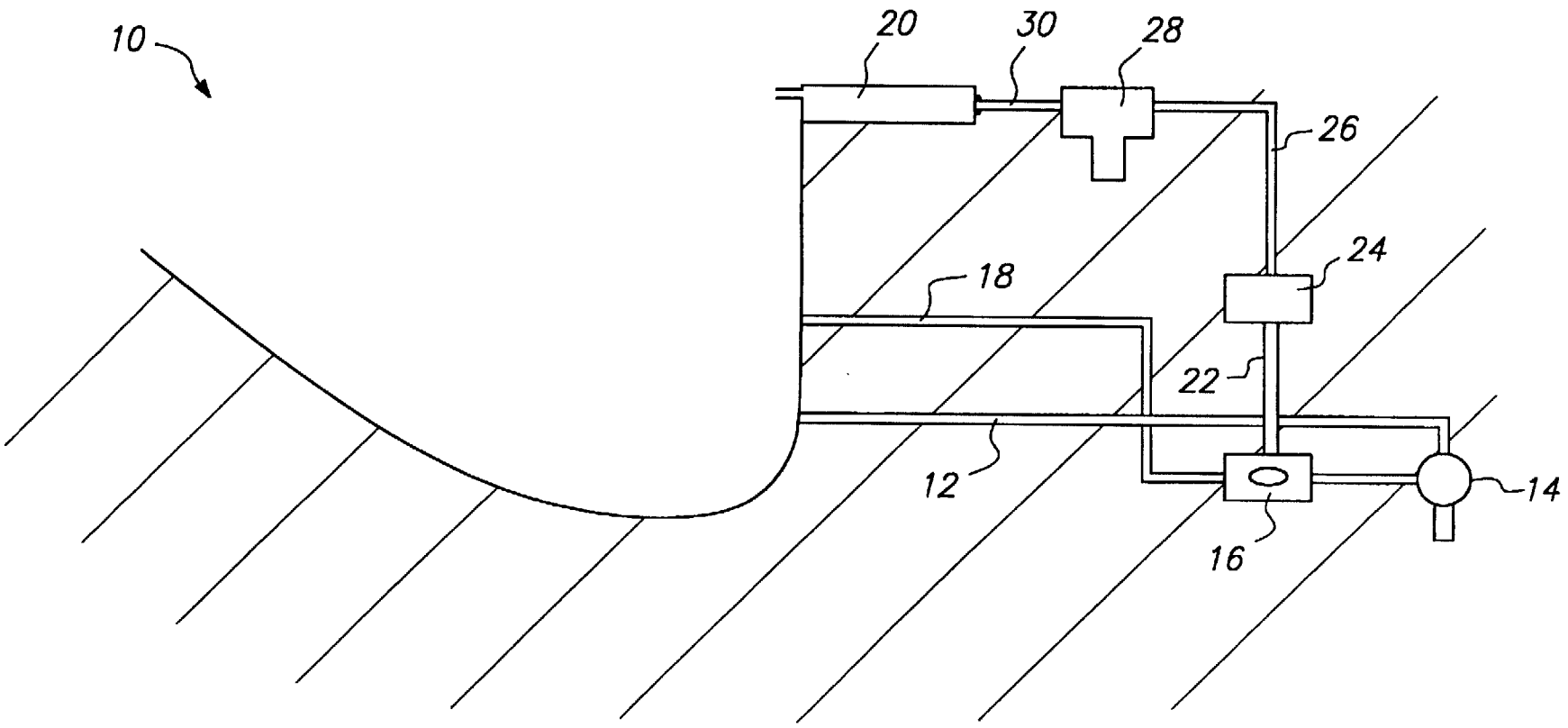
FIG. 1 is a schematic drawing of a possible configuration for a pool equipped with a waterfall fixture according to the present invention.

FIG. 1 shows an example of a waterfall fixture of the present invention connected to a pool. While the plumbing system may vary from installation to installation, the schematic of FIG. 1 generally illustrates a standard system. A typical recirculation system needed to operate a waterfall fixture of the present invention begins with a suction line 12 which is connected directly the pool 10. As so assembled, the pool 10 becomes the water source for the waterfall. Water from the pool is suctioned through the suction line 12 by a filter pump 14. The filter pump 14 acts as a first line for preventing debris from entering the waterfall fixture. Water is then passed from the pump 14 through a three way valve 16. At the valve 16, water can either be routed back to the pool 10 via a pool return line 18, or can be routed towards the waterfall fixture 20 via a line 22. Water routed into the pool return line 18 simply returns directly to the pool 10. Water routed to the waterfall fixture 20 by the valve 16 next passes through an inline filter 24 which again acts to strain debris from the water being passed to the waterfall fixture 20. The water then passes through a line 26 and a rock trap 28. The rock trap 28 consists of a screen and a container. When the fluid passes through the screen, debris that remains in the water will hit the screen, lose velocity, and fall into the container, allowing the filtered water to pass on to the waterfall fixture 20 of the present invention by a line 30.

Figure 2:
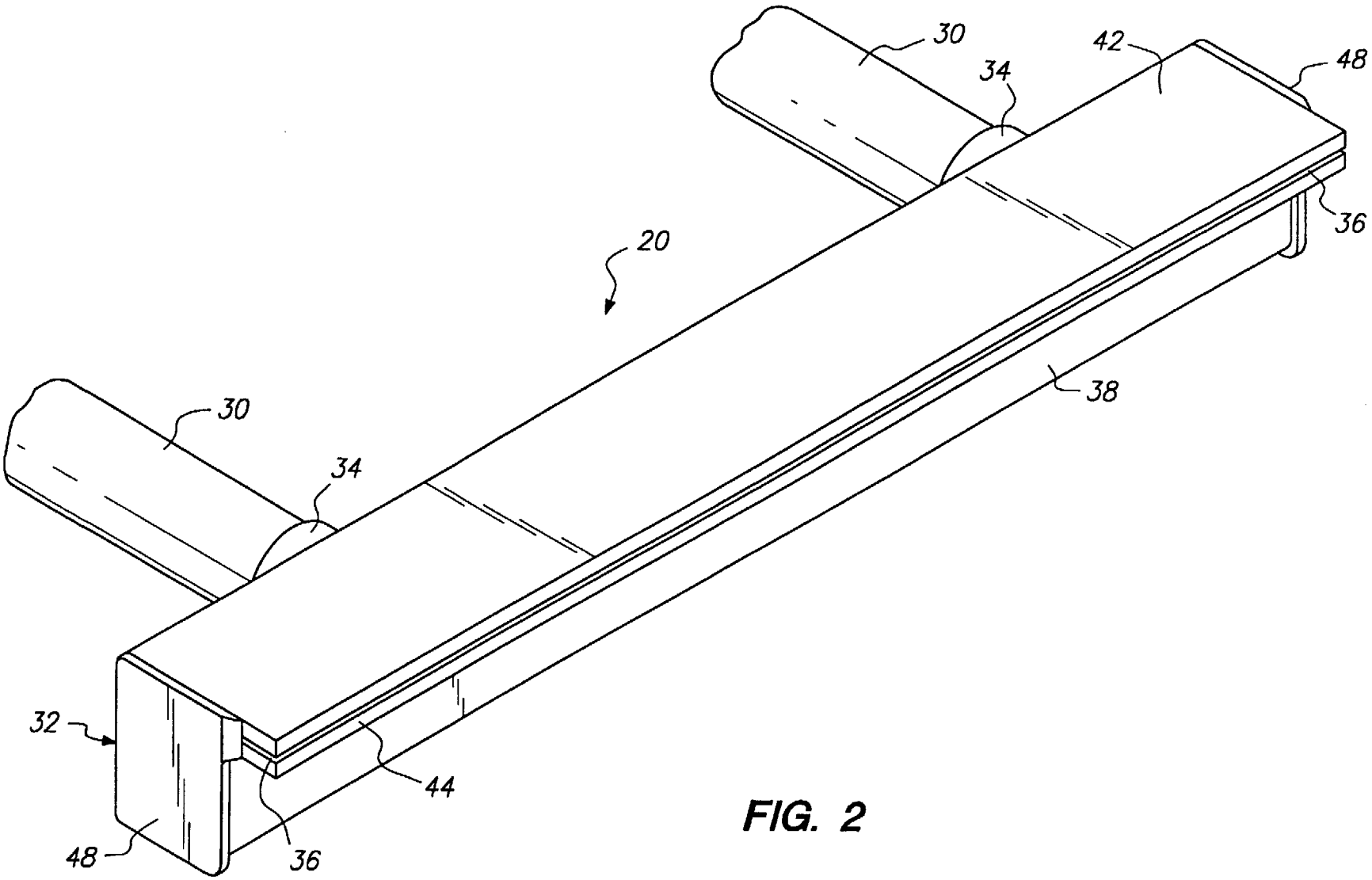
FIG. 2 is a perspective view of the housing of a fixture constructed according to the present invention.

As seen in FIG. 2, the waterfall fixture 20 of the present invention consists of a housing 32, which is adapted to be connected to the water inlet line 30. FIG. 2 shows two water inlets 34 connected to paired inlet lines 30. It should be understood that the number of water inlets will vary with the length of the desired waterfall fixture, with longer fixtures using greater numbers of water inlets. Fixtures of less than six feet in length generally include a single inlet. The fixture 20 also includes a water outlet 36 in the form on a longitudinal opening formed in the upper corner of the fixture 20 on the side opposite the water inlets 34. Water will eventually pass through this outlet, forming a sheetlike waterfall. The difficulty stems from forcing the water that enters the fixture through the pipe-like inlets 34 to spread evenly while inside the conduit formed within the housing 32 in order to form a sheetlike waterfall when it exits the fixture through the longitudinal outlet 36. In order to smooth the water within the fixture, as well as to reduce its velocity so that a pleasing, gentle, sheetlike waterfall may be accomplished, the present invention utilizes a series of apertured divider plates which serve as screens and resistors for water passing therethrough.

The housing 32 is common to all embodiments of the invention and may be seen in detail in FIGS. 4 to 8. It is fabricated of a generally U-shaped extruded PVC component 38 defining a cavity 40 therein having a width of approximately 1½ inches and a height of approximately 2 inches, as viewed in FIGS. 3, 4 and 5. The inlet 34 is sealingly secured to an aperture cut in the back wall of the U-shaped component 38 to provide a conduit to the cavity 40. The top of the component 38 is closed by a cap 42 which, together with a lower extension 44 and spacers 46 define the outlet 36. The cap 42, lower extension 44 and spacers 46 are adhered together and all fabricated of PVC. The ends of the U-shaped component 38 are closed by PVC end plates 48 (see FIGS. 2, 6, 7 and 8), also adhered in place.

The apertured divider screen plates of the fixture are fabricated of extruded PVC having a thickness of from 0.032 to 0.040 inches. In the preferred embodiment, the apertures within the plates have a diameter of approximately 0.125 inches and have a center-to-center spacing of from 0.1875 to 0.250 inches. The slotted outlet 36 has a height of approximately 0.125 inches, as defined by the spacers 46. Thus, the apertures in the plates function to screen out any debris which may have a cross-section greater than 0.125 inches, with the result that such debris cannot reach the outlet 36.

Figure 9:
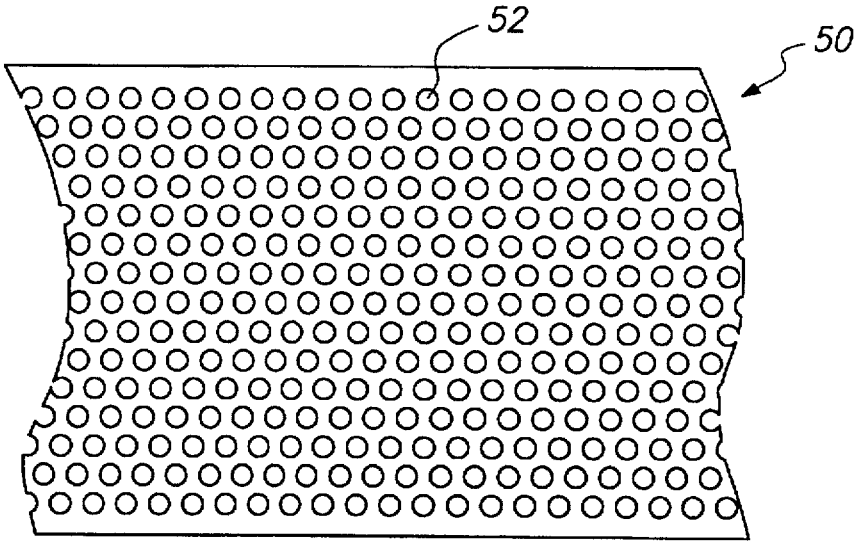
FIG. 9 is a plan view of a high density hole pattern which may be used for the screens in the fixture of the present invention.

FIG. 9 illustrates an apertured divider screen plate 50 having a high density aperture pattern where the apertures 52 have a diameter of approximately 0.125 inches and a center-to-center spacing of 0.1875 inches. This screen pattern is ideally suited for use as the first plate which is encountered by water which enters the inventive fixture.

Figure 10:
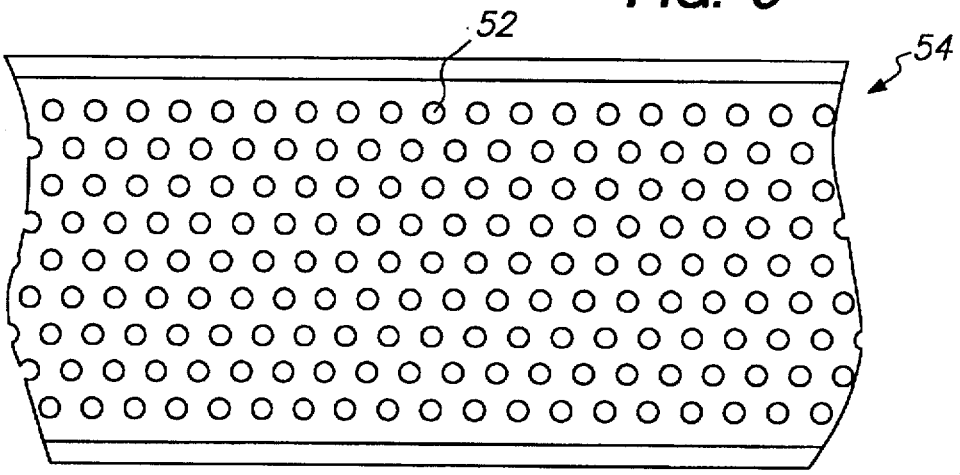
FIG. 10 is a plan view of a low density hole pattern which may be used for the screens in the fixture of the present invention; and, FIG. 11 is a plan view of a high density hole pattern screen which may be used in the fixture of the present invention, modified by a barrier to reduce the density of the hole pattern.

FIG. 10 shows a screen plate 54 having an aperture pattern of a lesser density than that of the plate 50. The apertures of the plate 54 are of the same 0.125 inch diameter as those of the plate 50 and, accordingly, are designated by the like numerals 52. In the case of the apertures of the plate 54, however, the center-to-center spacing of the apertures is 0.250 inches. This ideally suits the plate 54 for use as the second or third divider screen plate of the inventive fixture.

Figure 7:
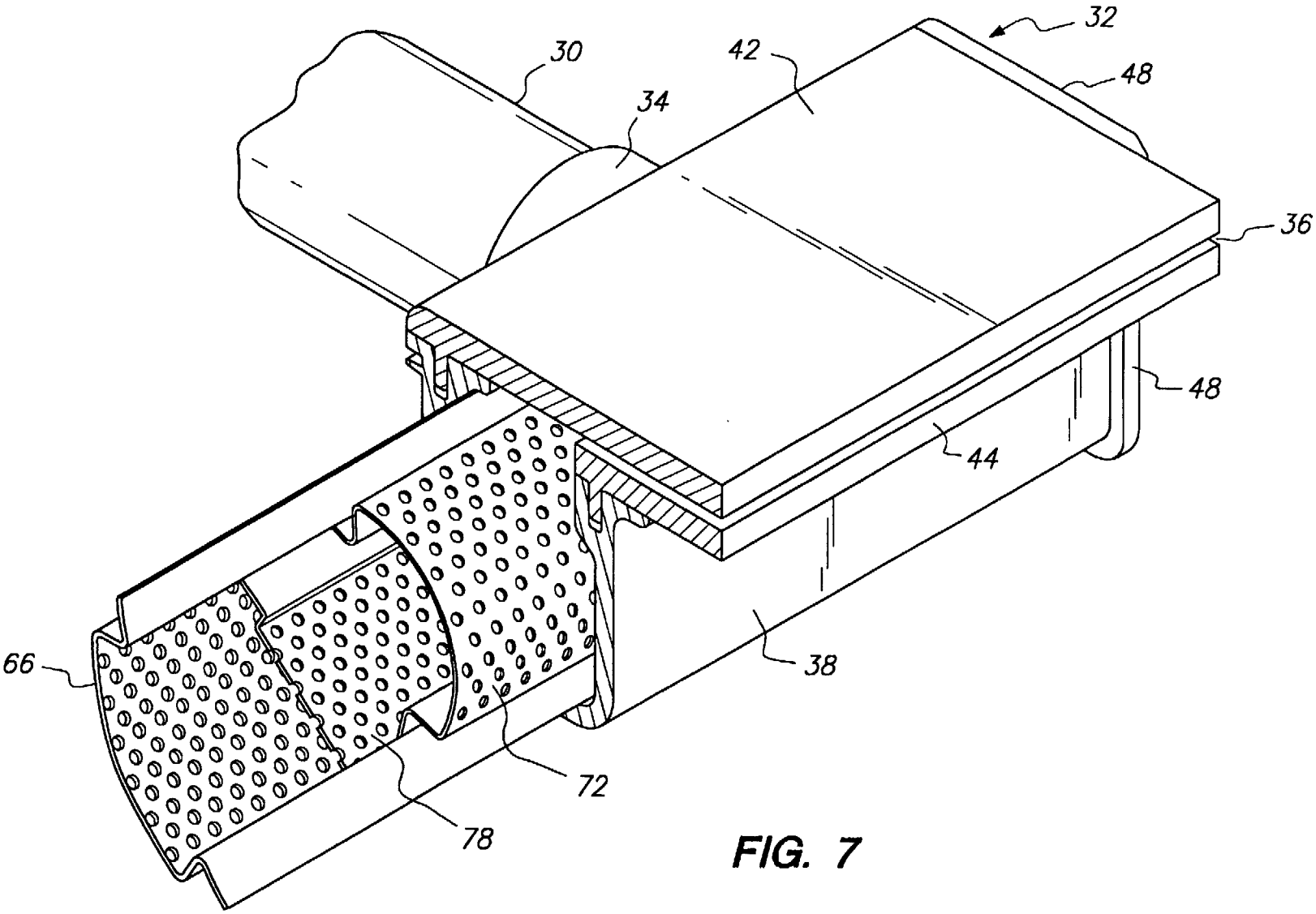
FIG. 7 is a perspective view of the three screen embodiment, with parts thereof broken away and shown in section.
Figure 11:
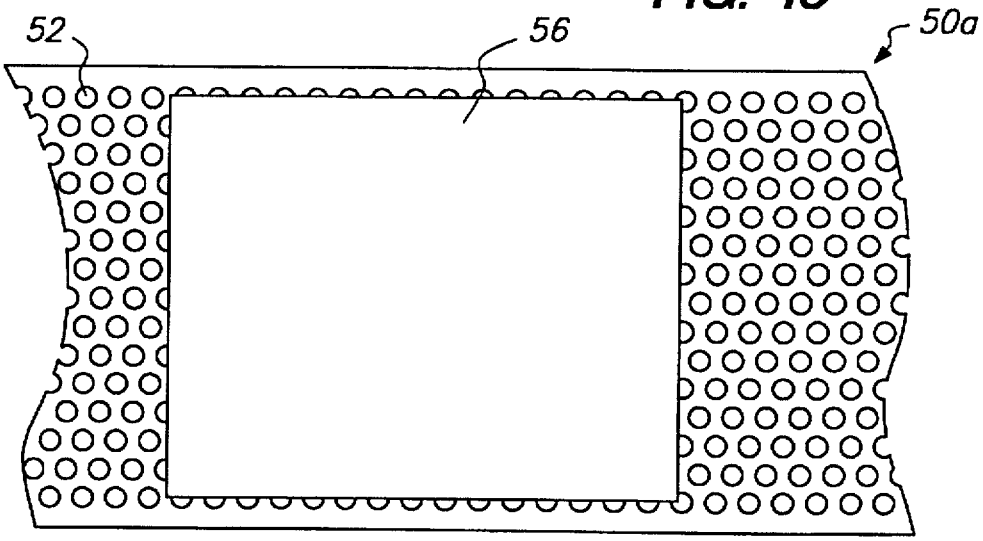

FIG. 11 illustrates a modified plate **50*a* corresponding to the plate 50 of FIG. 7, with the addition that a small imperforate plate 56 is adhered over the plate 50*a* to block certain of the apertures in the plate and thus reduce their density and increase the flow resistance provided by the plate. The apertures of the plate 50*a* are designated by the numeral 52 and are dimensioned and spaced the same as those of the plate 50**. As an alternative to adhering a plate over the apertures to reduce aperture density, the aperture density may be reduced by manufacturing the apertured plates with imperforate areas.

First Embodiment

Figure 3:
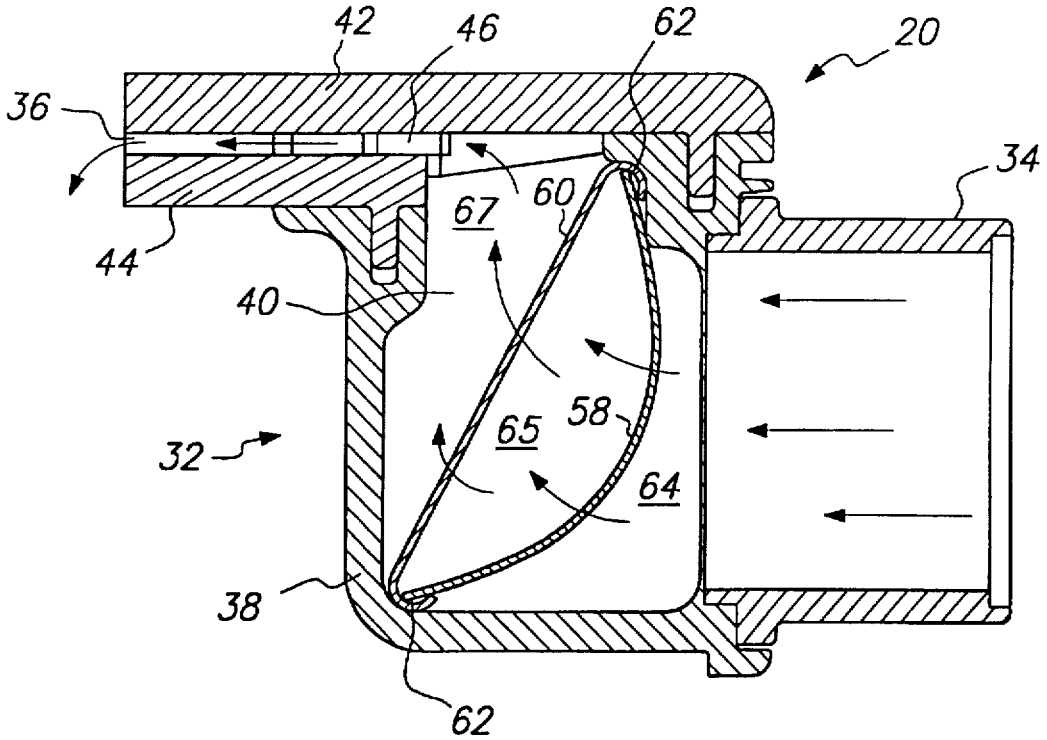
FIG. 3 is a cross-sectional elevational view of a two screen embodiment of a waterfall fixture constructed according to the invention.
Figure 6:
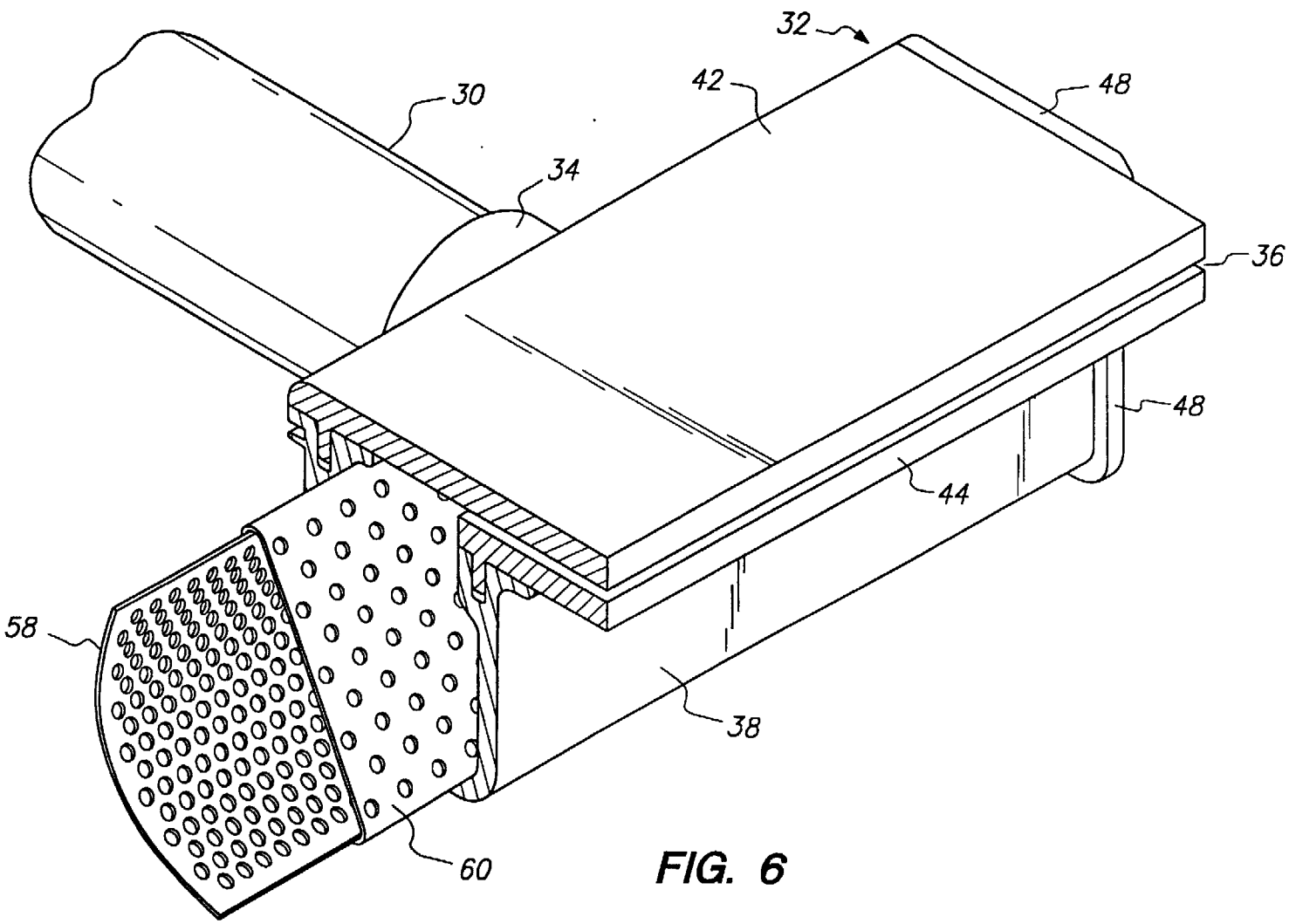
FIG. 6 is a perspective view of the two screen embodiment, with parts thereof broken away and shown in section.

The first embodiment illustrated in FIGS. 3 and 6 includes first and second divider screen plates 58 and 60, respectively, extending through the length of the housing from top to bottom to screen and smooth water flow from the inlet 34. The second screen plate 60 extends diagonally across the cavity 40 and has inwardly curved ends 62. The first plate 58 has upper and lower edges engaged in the inwardly curved ends 62 of the second plate to assume a condition bowed out toward the inlet 34. As so positioned and held, the plates 58 and 60 define a first chamber 64 between the first plate 58 and the inlet 34, a second chamber 65 between the first plate 58 and second plate 60, and a third chamber 67 between the second plate 60 and the outlet 36.

The plates 58 and 60 are so proportioned and positioned within the cavity 40 that no water may pass from the inlet 34 to the outlet 36 without passing through the plates. Water travelling into the fixture from the inlet 34 impacts the divider plate 58 first before passing through the fixture. The plate 58 is constructed with a fairly high density aperture pattern, as seen for example by the screen or plate 50 of FIG. 9. The openings of the plate are of generally the same size or smaller than the minimum width dimension of the outlet 36. The many openings 52 provided in the first plate serve both to help distribute the water into a laminar flow and block debris from entering the fixture. (Even though water which reaches the first plate 58 will already have been filtered through at least an in-line filter and rock trap, some small debris may still remain in the water.) Upon encountering the first divider plate 58 with its many openings 50, any debris remaining in the water should be filtered out. The debris will hit the plate 58, slowing its velocity, and then fall to the bottom of the cavity 40 where it will be retained harmlessly, since it will provide no restriction to the eventual outlet 36. Water which passes through the first divider plate 58 moves into the chamber 66 and then through the second divider plate 60. The second plate 60 has a restricted apertured area to more perfectly smooth and distribute the water in order to form a perfect laminar sheet of water exiting through the outlet 36. To provide the restricted apertured area, the plate 60 may be constructed with a reduced number of apertures either through means of increasing the center-to-center spacing of the apertures, as exemplified by the plate 54 of FIG. 10, or by covering or eliminating certain of the apertures, as exemplified by the plate 50*a* of FIG. 11. Another method of providing restrictions in the second plate is to reduce the size of the apertures in the second plate. The smaller apertures would also work to restrict the flow through the second plate, resulting is a more perfect laminar flow of water exiting through the outlet 36. Water passing through the fixture is also further distributed to a laminar form within the chamber 68.

Second Embodiment

Figure 4:
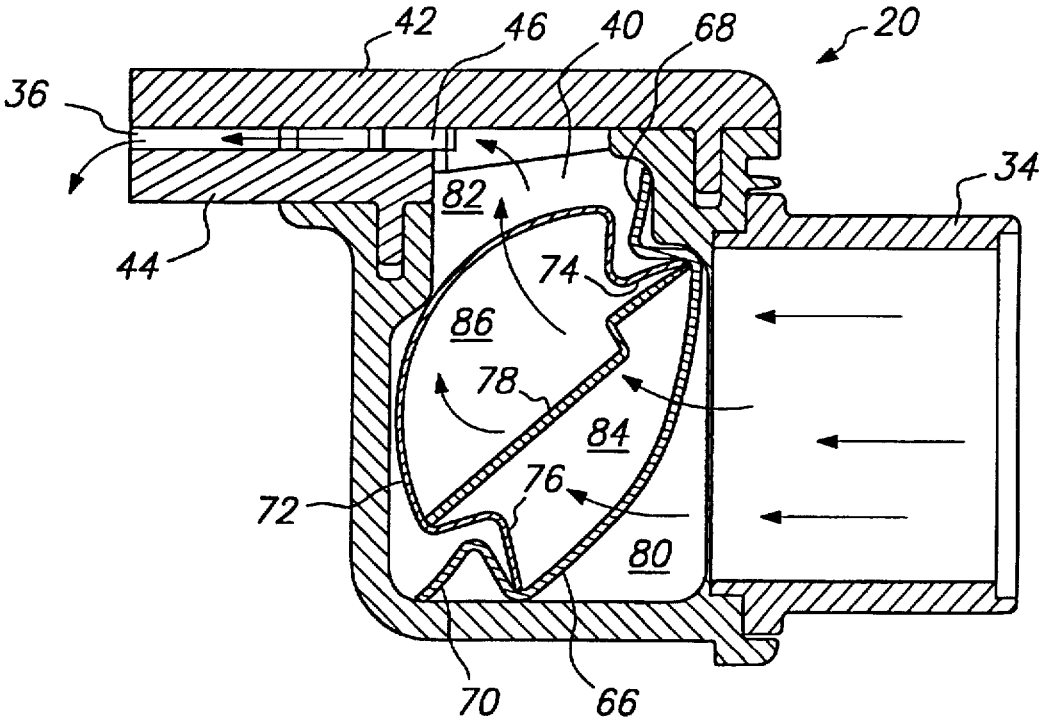
FIG. 4 is a cross-sectional elevational view of a three screen embodiment of a waterfall fixture constructed according to the invention.

FIGS. 4 and 7 show a second embodiment of the present invention in which three apertured divider screen plates are used within the fixture. The first plate, designated 66, extends diagonally across the cavity 40 in direct apposition to the inlet 34 and is of a densely apertured construction corresponding generally to that of the plate 50 depicted in FIG. 9. The plate 66 is convex toward the inlet 34 and has generally L-shaped upper and lower edge portions 68 and 70, respectively, engaged with the interior of the cavity 40. The final divider plate of the second embodiment, designated 72, is convex toward the outlet 36 and has upper and lower L-shaped legs 74 and 76, respectively, engaged within the legs 68 and 70 of the plate 66. An intermediate divider screen plate 78 extends diagonally across the area between the plates 66 and 72 and has a lower end portion engaged at the juncture of the L-shaped legs 76 with the plate 72 and an upper end portion engaged at the juncture of the L-shaped leg 68 with the plate 66.

The plates 66, 72 and 78 extend over the entire length of the cavity and define four chambers within the cavity, namely a first chamber 80 between the first plate 66 and the inlet 34, a final chamber 82 between the final plate 72 and the outlet 36, a third chamber 84 between the first plate 66 and the third plate 78, and a fourth chamber 86 between the final plate 72 and the intermediate plate 78.

In the preferred arrangement, the first plate 66 has a relatively dense aperture pattern, such as that of the plate 50 depicted in FIG. 9. It may also be partially covered with a deflector plate at the entry of the inlet 34. The final plate 72 has a more restricted aperture pattern, such as that of the plate 54 of FIG. 10, or that provided by partially blocking the apertures of a plate, for example in the manner depicted in FIG. 11. Another alternative for reducing the aperture flow area of the final plate is to reduce the size of the apertures in the plate. The intermediate plate 78 also has a reduced aperture density, which may be provided by any of the expedients which have been described.

Water entering the fixture through the inlet 34 impacts the first plate 66. This functions to filter debris from the water and reduce its velocity, thus creating laminar flow within the chamber 80 and permitting debris to settle to the bottom of the cavity 40. From the first plate 66 water passes into the chamber 84 and impacts the plate 78. The plate 78 serves primarily to further smooth and divert the water flowing through the fixture so as to eventually produce a perfect sheet-like laminar flow when the water exits through the outlet 36. From the plate 78 water passes into the chamber 86 and through the final apertured plate 72. The plate 72 acts as a final barrier for water before exiting the outlet 36. Again, the apertures within the plate 72 serve the purpose of further diverting the flow of water and slowing its velocity in order to yield a perfect sheet-like laminar stream of water flowing through the outlet 36.

Third Embodiment

Figure 5:
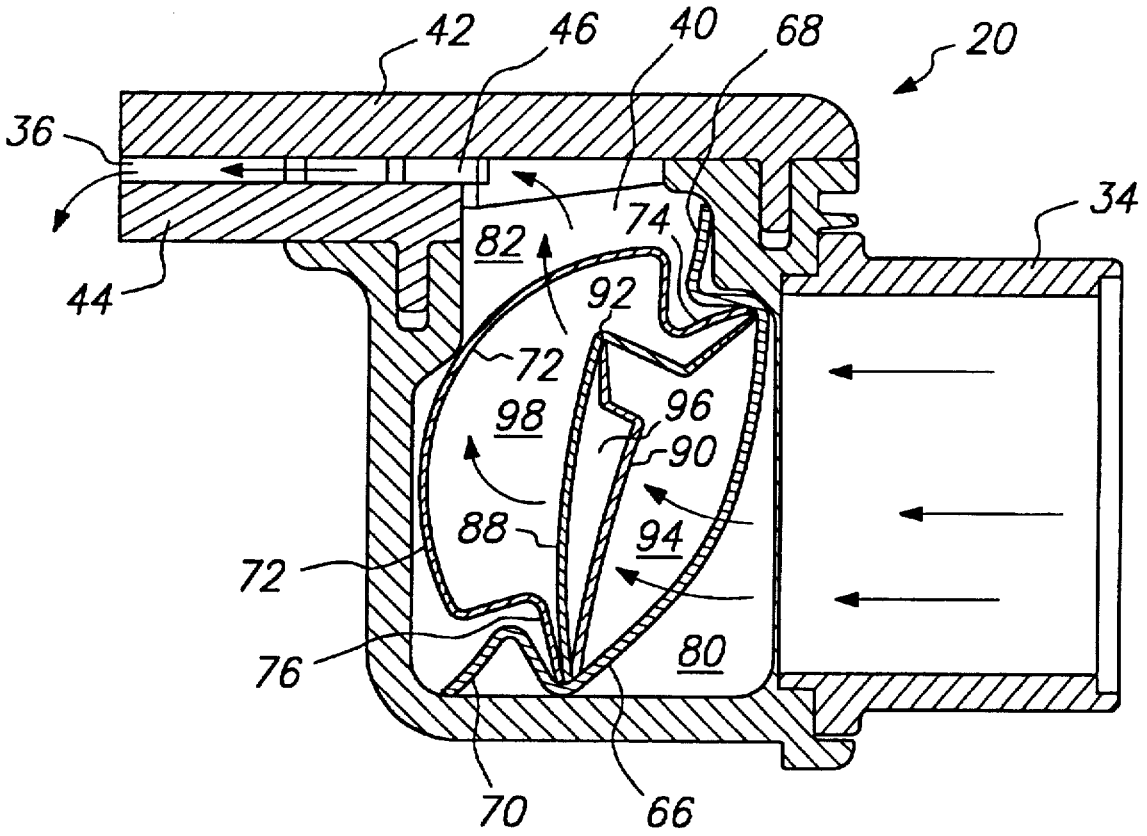
FIG. 5 is a cross-sectional elevational view of a four screen embodiment of a waterfall fixture constructed according to the present invention.
Figure 8:
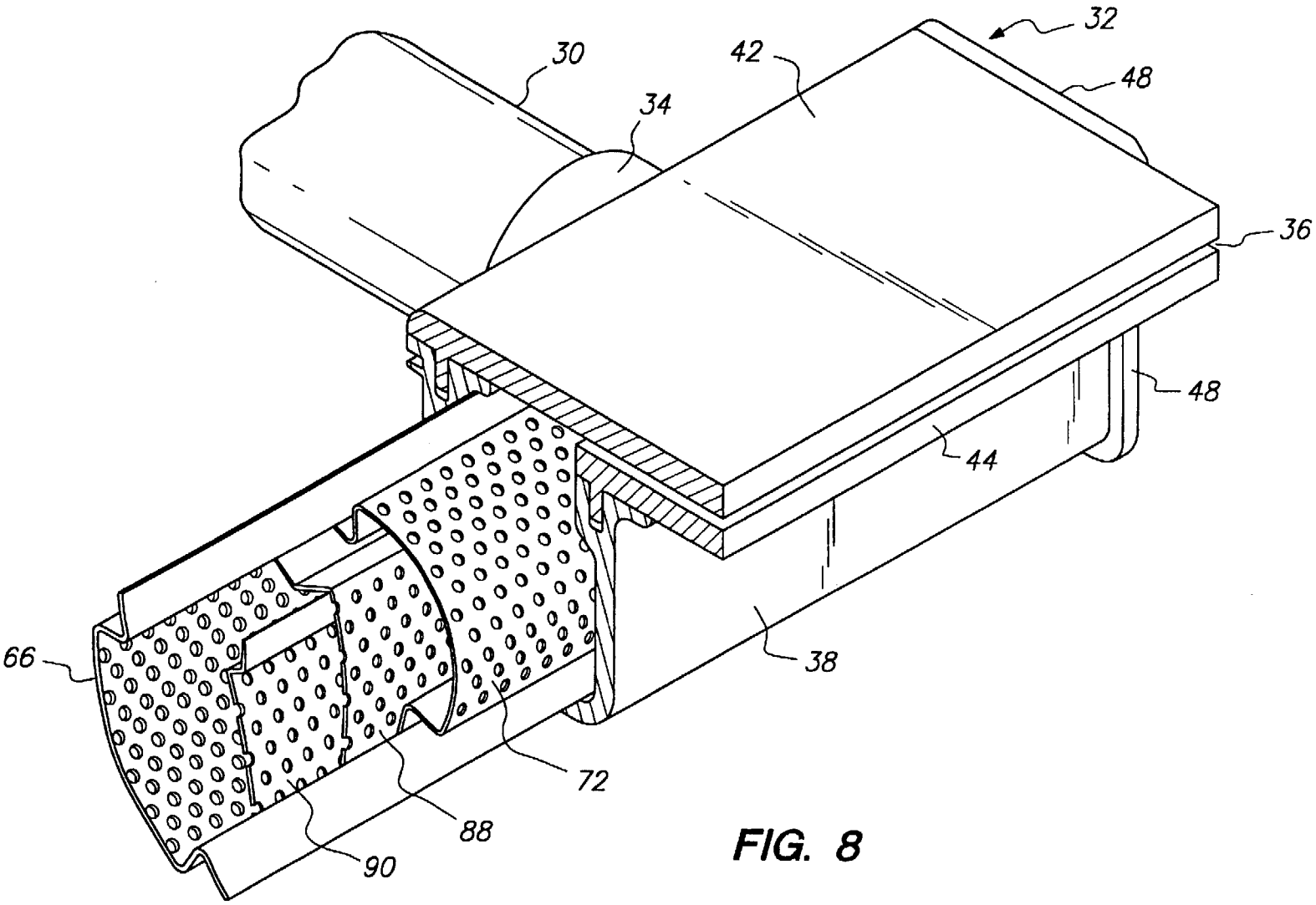
FIG. 8 is a perspective view of the four screen embodiment, with parts thereof broken away and shown in section.

FIGS. 5 and 8 illustrate a third embodiment of the present invention in which four apertured divider plates are used within the fixture. The first divider plate and the final divider plate of this embodiment correspond to those of the second embodiment and are designated by like numerals, as follows: first plate 66; L-shaped upper and lower edge portions 68 and 70, respectively; final divider plate 72; and upper and lower L-shaped legs 74 and 76, respectively. The third embodiment differs from the second embodiment in that it is provided with a pair of intermediate divider screen plates disposed between the plates 66 and 72. The first of these intermediate plates is designated 88 and is of generally dog-leg shaped configuration having upper and lower edges engaged with the plate 66 at the junctures of the L-shaped legs 68 and 70 with the plate 66. The second of the intermediate plates is designated 90 and is also of a generally dog-leg shaped configuration having a lower edge portion engaged with the first plate 66 at the juncture of the L-shaped leg 70 and an upper portion engaged with a corner 92 of the plate 88.

The plates 66, 72, 88 and 90 extend over the length of the cavity and define five chambers within the cavity. Two of these correspond to the first and final chambers 80 and 82 of the second embodiment and are designated by like numerals. The other three are within the volume contained between the plates 72 and 76 and are designated as follows: 94 for the chamber between the plate 66 and the plate 90; 96 for the chamber between the plates 88 and 90; and 98 for the chamber between the plates 72 and 88.

In the third embodiment, the first plate has a relatively dense aperture pattern, such as that of the plate 50 depicted in FIG. 9. It may also be partially covered with a deflector plate at the entry of the inlet 34. The final plate 72 has a more restricted aperture pattern, such as that of the plate 54 in FIG. 10, or that provided by partially blocking the apertures of the plate, for example in the manner depicted in FIG. 11. An alternative for reducing the aperture flow area of the final plate is to reduce the size of the apertures in the plate. The intermediate plates 88 and 90 also have a reduced aperture density, which may be provided by any of the expedients which have been described.

Water entering the third embodiment fixture through the inlet 34 impacts the first plate 66. This functions to filter debris from the water and reduce its velocity, thus creating laminar flow within the chamber 80 and permitting debris to settle to the bottom of the cavity 40. From the first plate 66, water passes into the chamber 94 and impacts the plate 90, from whence it passes through the chamber 96 and impacts the plate 88. The plates 88 and 90 serve to further smooth and divert water flowing through the fixture. From the plate 88 the water flows into the chamber 98 and impacts the plate 72. From the plate 72 the water flows through the chamber 82, by which time the combined action of the plates produces a perfect sheet like laminar flow when the water exits through the outlet 36.

CONCLUSION

The embodiments described above define spaces or chambers between each of the divider screen plates which allow water to flow and mix. These chambers allow for velocity change in the water and help to eliminate strong currents which affect water sheeting action. Further apertured plates may be added, each providing a chamber and the option of further restricting water flow before it reaches the water flow outlet. Other modifications include variations in the type and size of apertures utilized and variation in the methods of blocking flow through the apertured plate members.

While preferred embodiments of the invention have been illustrated and described, it should be understood that the invention is not intended to be limited to the specifics of these embodiments, but rather is defined by the accompanying claims.

What is claimed is:

1. A waterfall fixture for expelling water in sheet form, said fixture comprising:

(a) a housing defining an elongate closed cavity having an inlet opening in one side for receiving water under pressure and an outlet opening spaced from the inlet opening for expelling water in sheet form, said outlet opening being elongate and extending longitudinally of the housing;

(b) a plurality of apertured divider plates extending longitudinally through the cavity between the inlet and outlet openings in spaced apposition to one another to define one or more chambers therebetween and a chamber to either side thereof in apposition to the inlet and outlet openings, said chambers being disposed in aligned succession between the inlet and outlet openings and said plates each defining a plurality of apertures.

2. The waterfall fixture of claim 1 wherein a first of the apertured plates is in direct apposition to the inlet opening and a final of the apertured plates is in apposition to the outlet opening, said final plate being more restrictive to the flow of water than the first plate.

3. The waterfall fixture of claim 2 wherein restriction is accomplished by using smaller apertures in the final divider plate than in the first divider plate.

4. The waterfall fixture of claim 2 wherein restriction is accomplished by blocking at least certain of the apertures in the final divider plate.

5. The waterfall fixture of claim 2 wherein restriction is accomplished by using fewer apertures in the final divider plate than in the first divider plate.

6. The waterfall fixture of claim 1 wherein:

a) a first of the apertured plates is in direct apposition to the inlet opening and functions to filter debris from water entering the cavity and reduce its velocity; and, b) successive plates of said plurality of plates are disposed between said first plate and the outlet opening, said successive plates, with the chambers disposed between the plates, serving to smooth, mix and divert water flowing through the fixture.

7. A waterfall fixture according to claim 6 wherein the successive plates form a composite more restrictive to the flow of water than the first plate.

8. The waterfall fixture according to claim 6 wherein said successive plates are more restrictive to the flow of water than the first plate.

9. The waterfall fixture of claim 8 wherein restriction is accomplished by using smaller apertures in the successive divider plates than in the first divider plate.

10. The waterfall fixture of claim 8 wherein restriction is accomplished by blocking at least certain of the apertures in the successive plates.

11. The waterfall fixture of claim 8 wherein restriction is accomplished by using fewer apertures in the successive divider plates than in the first divider plates.

12. The waterfall fixture of claim 6 wherein:

a) the divider plates are fabricated of 0.032 to 0.040 inch extruded PVC;

b) the apertures in the plates have a diameter of approximately 0.125 inches;

c) the apertures in the first plate are on approximately 0.185 inch centers; and d) the apertures in a successive one of said plates are on approximately 0.250 inch centers.

13. The waterfall fixture of claim 1 wherein:

a) the outlet opening defines a generally horizontally extending slot having spaced upper and lower edges; and, b) the apertures in at least one of said divider plates each have a maximum cross-section no greater than the spacing between the upper and lower edges of the slot.

14. The waterfall fixture of claim 1 wherein at least one of the divider plates is bowed outwardly relative to another of the plates to provide a chamber between said one and other plates.

15. The waterfall fixture of claim 1 wherein at least one of the divider plates extends diagonally across the cavity from top to bottom and another of the divider plates has edges engaged with said one divider plate at the top and bottom of the cavity and an intermediate portion bowed out relative to said one divider plate to provide a chamber between said one and other plates.

16. The waterfall fixture of claim 1 wherein the divider plates are fabricated of 0.032 to 0.040 inch extruded PVC and the apertures in the plates have a diameter of approximately 0.125 inches and have a center spacing of from 0.1875 to 0.250 inches.

17. A waterfall fixture comprising:

a) a housing having an inlet opening for receiving water under pressure and outlet opening for expelling water in sheet form, said outlet opening being of a generally slot shaped horizontal configuration with spaced upper and lower edges;

b) an elongate cavity formed within the housing through which water can pass from the inlet opening to the outlet opening, said outlet opening extending longitudinally of and opening through one side of the cavity;

c) a first divider plate extending longitudinally through and across the cavity to define a chamber between said first plate and the inlet opening, said first divider plate having a plurality of spaced apertures extending therethrough;

d) a second divider plate extending longitudinally through the cavity to define a chamber between the second plate and the outlet opening, said second divider plate being spaced from the first divider plate and having a plurality of spaced apertures extending therethrough;

e) a third divider plate extending longitudinally through the cavity between the first and second plates to define chambers between said third plate and each of said first and second plates, said third divider plate having a plurality of spaced apertures extending therethrough and wherein;

f) the respective chambers are disposed in aligned succession between the inlet and outlet openings.

18. The waterfall fixture of claim 17 wherein the apertures in at least one of said first, second or third plates each have a maximum cross-section no greater than the spacing between the upper and lower edges of the slot.

19. The waterfall fixture of claim 17 wherein the third divider plate is more restrictive to flow than the first divider plate.

20. The waterfall fixture of claim 19 wherein restriction is accomplished by using smaller apertures in the third divider plate than in the first divider plate.

21. The waterfall fixture of claim 19 wherein restriction is accomplished by blocking at least certain of the apertures in the third divider plate.

22. The waterfall fixture of claim 19 wherein restriction is accomplished by using fewer apertures in the third divider plate than in the first divider plate.

23. The waterfall fixture of claim 17 wherein at least one of said first and second divider plates is bowed outwardly relative to the other to provide the chamber between the plates.

24. The waterfall fixture of claim 17 wherein the first divider plate extends diagonally across the cavity from top to bottom and the second divider plate has edges engaged with first divider plate adjacent the top and bottom of the cavity and an intermediate portion bowed out relative to the first divider plate to provide the chamber between the plates.

25. The waterfall fixture of claim 24 wherein the third divider plate is captured between the first and second divider plates.

26. The waterfall fixture of claim 17 wherein the divider plates are fabricated of 0.032 to 0.040 inch extruded PVC and the apertures in the plates have a diameter of approximately 0.125 inches and have a center spacing of from 0.1875 to 0.250 inches.

27. A waterfall fixture for expelling water in sheet form, said fixture comprising:

a) a housing defining an elongate closed cavity having an inlet opening in one side for receiving water under pressure and an outlet slot spaced from the inlet opening for expelling water in sheet form, said outlet slot having spaced upper and lower edges, being elongate, and extending longitudinally of the housing;

b) a plurality of apertured divider screen plates extending longitudinally through the cavity between the inlet opening and outlet slot in spaced apposition to one another to define one or more chambers therebetween and a chamber to either side thereof in apposition to the inlet opening and outlet slot, said plates each defining a plurality of screening apertures; and wherein:

1) a first of said plates is disposed in opposed spaced relationship to the inlet opening to define the chamber in apposition to the inlet opening; and 2) the apertures in the first plate have a cross-section no greater than the spacing between the upper and lower edges of the outlet slot.

28. A waterfall fixture for expelling water in sheet form, said fixture comprising:

a) a housing defining an elongate closed cavity having an inlet opening in one side for receiving water under pressure and an outlet slot for expelling water in sheet form, said outlet slot having spaced upper and lower edges, being elongate, and extending longitudinally of the housing;

b) a plurality of apertured divider screen plates extending longitudinally through the cavity between the inlet opening and outlet slot in spaced apposition to one another to define one or more chambers therebetween and a chamber to either side thereof in apposition to the inlet opening and outlet slot, said plates each defining a plurality of screening apertures; and wherein:

the apertures in at least one of the screening plates have a cross-section no greater than the spacing between the upper and lower edges of the outlet slot.

* * * * *